US010077164B2

(12) United States Patent
Kotani et al.

(10) Patent No.: US 10,077,164 B2
(45) Date of Patent: Sep. 18, 2018

(54) SHEET DISCHARGE DEVICE AND IMAGE FORMING APPARATUS

(71) Applicant: KYOCERA Document Solutions Inc., Osaka (JP)

(72) Inventors: Takashi Kotani, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/489,412

(22) Filed: Apr. 17, 2017

(65) Prior Publication Data

US 2017/0305701 A1 Oct. 26, 2017

(30) Foreign Application Priority Data

Apr. 25, 2016 (JP) ..... 2016-087308

(51) Int. Cl.

| | |
|---|---|
| ***B65H 31/18*** | (2006.01) |
| ***B65H 31/10*** | (2006.01) |
| ***B65H 43/06*** | (2006.01) |
| ***B65H 43/02*** | (2006.01) |
| ***B65H 43/04*** | (2006.01) |
| ***B65H 43/08*** | (2006.01) |

(52) U.S. Cl.

CPC ..... *B65H 31/10* (2013.01); *B65H 31/18* (2013.01); *B65H 43/02* (2013.01); *B65H 43/04* (2013.01); *B65H 43/06* (2013.01); *B65H 43/08* (2013.01); *B65H 2301/4213* (2013.01); *B65H 2405/11151* (2013.01); *B65H 2511/20* (2013.01); *B65H 2511/22* (2013.01); *B65H 2511/24* (2013.01); *B65H 2511/30* (2013.01); *B65H 2513/40* (2013.01); *B65H 2513/53* (2013.01); *B65H 2551/20* (2013.01); *B65H 2801/27* (2013.01)

(58) Field of Classification Search

CPC ..... B65H 31/10; B65H 31/18; B65H 43/06; B65H 43/08

See application file for complete search history.

(56) References Cited

U.S. PATENT DOCUMENTS

| | | | | |
|---|---|---|---|---|
| 8,708,336 | B2 * | 4/2014 | Taguchi | G03G 15/6544 271/207 |
| 2014/0183814 | A1 * | 7/2014 | Matsumine | G03G 15/6552 271/213 |

FOREIGN PATENT DOCUMENTS

| | | | |
|---|---|---|---|
| JP | 11130321 | A * | 5/1999 |
| JP | 2000038248 | A * | 2/2000 |

(Continued)

*Primary Examiner* — Luis A Gonzalez
(74) *Attorney, Agent, or Firm* — Stein IP, LLC

(57) ABSTRACT

When a discharge count has exceeded a specified number of sheets, a sheet discharge device executes a process of moving down a discharge tray by a specified quantity and thereafter moving up the discharge tray until a top-surface detection part outputs a top-surface detection signal, while clocking a move-up time lasting from a move-up start of the discharge tray until output of the top-surface detection signal by the top-surface detection part. When the move-up time is equal to or less than a reference time, the sheet discharge device makes a next sheet discharged while the top-surface detection part outputs the top-surface detection signal; on the other hand, when the move-up time is more than the reference time, the sheet discharge device executes a correction process of moving down the discharge tray before making the next sheet discharged.

6 Claims, 8 Drawing Sheets

(56) References Cited

FOREIGN PATENT DOCUMENTS

| | | | | |
|---|---|---|---|---|
| JP | 2006069711 | A | * | 3/2006 |
| JP | 2006-273581 | A | | 10/2006 |
| JP | 2014221679 | A | * | 11/2014 |

* cited by examiner

SHEET DISCHARGE DEVICE AND IMAGE FORMING APPARATUS

INCORPORATION BY REFERENCE

This application is based upon and claims the benefit of priority from the corresponding Japanese Patent Application No. 2016-087308 filed on Apr. 25, 2016, the entire contents of which are incorporated herein by reference.

BACKGROUND

The present disclosure relates to a sheet discharge device, as well as an image forming apparatus, for discharging a sheet.

Conventionally, there is known a sheet discharge device for performing postprocessing (punching process, stapling process, etc.) on a sheet before discharging the sheet.

A conventional sheet discharge device includes a discharge roller pair provided at a sheet discharge outlet, a top-surface detection part placed at a position under the discharge roller pair, a discharge tray on which sheets are to be stacked, and the like. The discharge tray is made up/down movable.

As has conventionally been the case, when a paper sheet is discharged onto a discharge tray, the discharge tray is moved down, and thereafter moved up until a top-surface detection part detects a sheet placed at the uppermost layer on the discharge tray, so that an up/down or vertical distance between the uppermost-layer sheet on the discharge tray and the sheet discharge outlet is maintained at a constant distance. As a result of this, a vertical-direction heightwise position of the uppermost-layer sheet on the discharge tray is normally maintained at a target position (a position free from interference with next-sheet discharge).

SUMMARY

A sheet discharge device according to a first aspect of the present disclosure includes a discharge tray, an up/down moving part, a sheet discharge part, a top-surface detection part, and a control section. The discharge tray, on which a sheet discharged from a sheet discharge outlet is to be stacked, is inclined obliquely upward from upstream side toward downstream side of a sheet discharge direction. The up/down moving part moves up and down the discharge tray in a vertical direction. The sheet discharge part discharges a sheet onto the discharge tray. The top-surface detection part, which has a detection position set at a position under the sheet discharge outlet, outputs a top-surface detection signal when a top surface of the discharge tray moved up by the up/down moving part or a top surface of a sheet on the discharge tray has arrived at the detection position. The control section, in order to make the sheet discharge part discharge a sheet onto the discharge tray, drives the up/down moving part to move up the discharge tray until the top-surface detection part outputs the top-surface detection signal, by which the top surface of the discharge tray or the top surface of the sheet on the discharge tray is made to reach the detection position, and the control section further executes a state decision process of deciding a stacking state of the sheet discharged on the discharge tray. While counting a discharge count of sheets discharged on the discharge tray, the control section keeps the state decision process unexecuted until the discharge count exceeds a specified number of sheets; when the discharge count has exceeded the specified number of sheets, the control section executes, as the state decision process, a process of moving down the discharge tray by a specified quantity and thereafter moving up the discharge tray until the top-surface detection part outputs the top-surface detection signal, while clocking a move-up time lasting from a move-up start of the discharge tray until output of the top-surface detection signal by the top-surface detection part. When the move-up time is equal to or less than a predetermined reference time, the control section decides that the stacking state is a normal state, where the control section makes a next sheet discharged while the top-surface detection part outputs the top-surface detection signal; on the other hand, when the move-up time is more than the reference time, the control section decides that the stacking state is an abnormal state, where the control section executes a correction process of moving down the discharge tray before making the next sheet discharged.

An image forming apparatus according to a second aspect of the disclosure includes the above-described sheet discharge device.

DETAILED DESCRIPTION (General Configuration of Multifunction Peripheral)

Figure 1:
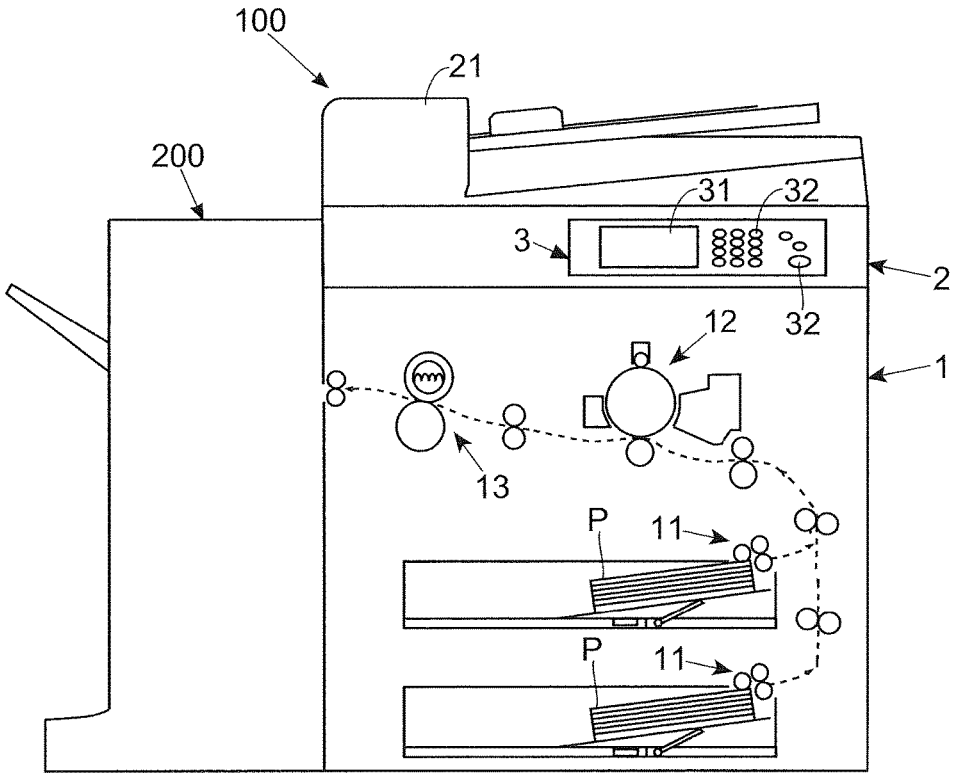
FIG. 1 is a view showing a general configuration of a multifunction peripheral according to one embodiment of the present disclosure.

As shown in FIG. 1, a multifunction peripheral 100 (corresponding to 'image forming apparatus') according to this embodiment includes a printing section 1 and an image reading section 2.

The printing section 1 conveys a paper sheet P along a sheet conveyance path (indicated by broken line in FIG. 1). The printing section 1 also forms a toner image based on image data of an image to be printed (e.g., image data of a document read by the image reading section 2). Then, the printing section 1 transfers the toner image to the sheet P under conveyance. In addition, the printing section 1 is composed of a sheet feed part 11 for feeding a sheet P housed in a sheet cassette onto the sheet conveyance path, an image forming part 12 for forming a toner image and transferring the image onto the sheet P, a fixing part 13 for fixing the toner image transferred on the sheet P, and the like.

The image reading section 2 includes a reading unit (not shown) made up of a light source, an image sensor or the like. The reading unit reads a document mounted on an unshown contact glass for mounting and reading use. The image reading section 2 also includes a document conveyance unit 21 for conveying the document onto an unshown contact glass for conveying and reading use. As to reading of the document using the document conveyance unit 21, while the document conveyed by the document conveyance unit 21 is passing through on the conveying-and-reading use contact glass, the document is read by the reading unit.

The multifunction peripheral 100 also includes an operation panel 3. The operation panel 3 includes a touch panel display 31, hardware keys 32, and the like. The touch panel display 31 displays software keys to accept various types of settings from a user. The touch panel display 31 further displays messages thereon to inform the user of various types of information. The hardware keys 32 are provided in plurality on the operation panel 3. For example, a start key for accepting an instruction for job execution from a user is provided on the operation panel 3 as a hardware key 32. The operation panel 3 corresponds to 'information part.'

In this case, the multifunction peripheral 100 includes a postprocessing device 200. During execution of a copying job or other job involving discharge of a sheet P (discharge of a printed sheet P with an image printed thereon), the multifunction peripheral 100 including the postprocessing device 200 carries the printed sheet P into the postprocessing device 200 and discharges the sheet P from the postprocessing device 200. For example, the postprocessing device 200 performs a postprocessing such as punching process or stapling process on the printed sheet P. In addition, the printed sheet P may be discharged as it is not subjected to any postprocessing. The postprocessing device 200 corresponds to 'sheet discharge device.'

(Configuration of Postprocessing Device)

Figure 2:
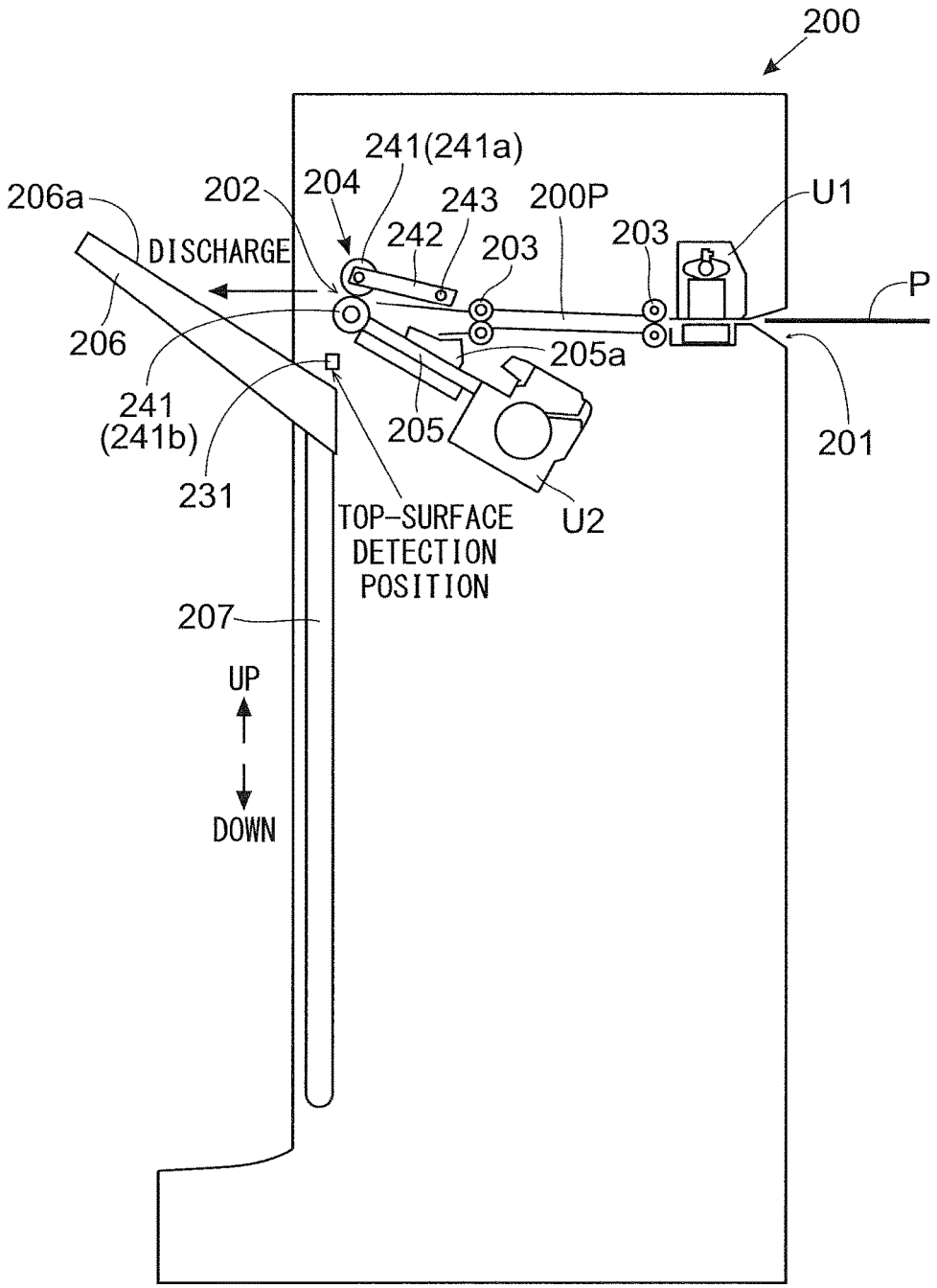
FIG. 2 is a view showing a configuration of a postprocessing device installed on the multifunction peripheral according to one embodiment of the disclosure.

As shown in FIG. 2, the postprocessing device 200 has a sheet carry-in inlet 201 for carrying in a paper sheet P, and a sheet discharge outlet 202 for discharging the sheet P. Then, the postprocessing device 200 conveys the sheet P, which has been carried in through the sheet carry-in inlet 201, along a sheet conveyance path 200P, performs postprocessing on the sheet P, and thereafter discharges the sheet P out of the sheet discharge outlet 202. In addition, the postprocessing device 200 is equipped with a plurality of conveyance roller pairs 203 for conveying the sheet P along the sheet conveyance path 200P. The postprocessing device 200 is also equipped with a sheet discharge part 204 for discharging the sheet P through the sheet discharge outlet 202.

Further, the postprocessing device 200 is equipped, for example, with a punching unit U1 and a stapling unit U2, as a part for executing the postprocessing. The punching unit U1 performs punching process on the sheet P. The stapling unit U2 performs stapling process on a sheet bundle (a stack of plural sheets P) mounted on a processing tray 205.

The processing tray 205 is inclined obliquely downward from its one end side (sheet discharge outlet 202 side) toward the other end side. Also, the processing tray 205 has a guide 205*a* movable in a widthwise direction of the sheet P. With such a guide 205*a* provided on the processing tray 205, the sheet P mounted on the processing tray 205 can be shifted widthwise before it is discharged. That is, a sorting process is enabled.

On one end side of the processing tray 205, a discharge roller pair 241 (upper roller 241*a* and lower roller 241*b*) is provided for discharging the sheet P through the sheet discharge outlet 202. One end of an arm 242 is connected to the upper roller 241*a*, and a pivotal shaft 243 is connected to the other end of the arm 242. With this arrangement, when one end of the arm 242 is pivoted upward on the pivotal shaft 243 serving as a fulcrum, the upper roller 241*a* is moved upward, so that the upper roller 241*a* goes apart from the lower roller 241*b*. On the other hand, when one end of the arm 242 is pivoted downward on the pivotal shaft 243 serving as a fulcrum, the upper roller 241*a* is moved downward, so that the upper roller 241*a* goes nearer to the lower roller 241*b*.

In addition, the discharge roller pair 241, the arm 242 and the pivotal shaft 243 are constituent members of the sheet discharge part 204. The sheet discharge part 204 includes a discharge motor M1 (see FIG. 3) for rotating the discharge roller pair 241.

For mounting of the sheet P on the processing tray 205, the upper roller 241*a* is moved apart from the lower roller 241*b*, and a fore end of the sheet P is advanced to between the upper roller 241*a* and the lower roller 241*b*. Thereafter, the sheet P is shifted obliquely downward along the mounting surface of the processing tray 205, for example, by an unshown paddle (or the sheet P is shifted obliquely downward by its self weight).

For discharging of the sheet P mounted on the processing tray 205, the upper roller 241*a* is moved nearer to the lower roller 241*b* so that the sheet P is nipped between the upper roller 241*a* and the lower roller 241*b*, in which state the upper roller 241*a* and the lower roller 241*b* are rotated. By this operation, the sheet P mounted on the processing tray 205 is discharged through the sheet discharge outlet 202. In addition, in the case where neither the stapling process nor the shifting process is performed, the sheet discharge part 204 discharges the sheet P through the sheet discharge outlet 202 without mounting the sheet P on the processing tray 205.

The sheet P discharged through the sheet discharge outlet 202 is stacked on a mounting surface 206*a* of a discharge tray 206. The mounting surface 206*a* of the discharge tray 206 is inclined obliquely upward from upstream side (sheet discharge outlet 202 side) toward downstream side of the sheet discharge direction. Also, the discharge tray 206 is made up/down movable.

Up/down movement of the discharge tray 206 is performed by an up/down moving part 207. For example, the up/down moving part 207, although not shown, includes a pair of pulleys placed with a distance therebetween in the up/down direction, which is the moving direction of the discharge tray 206, an up/down belt to which the discharge tray 206 is fitted and which is stretched on and between the pair of pulleys, an up/down guide for guiding up/down movement of the discharge tray 206, and the like. With this structure, as the pulleys are rotated, the up/down belt is revolved orbitally, by which the discharge tray 206 fitted to the up/down belt is moved up and down. In addition, the up/down moving part 207 includes an up/down motor M2 (see FIG. 3) for rotating the pulleys.

<Hardware Configuration of Multifunction Peripheral>

Figure 3:
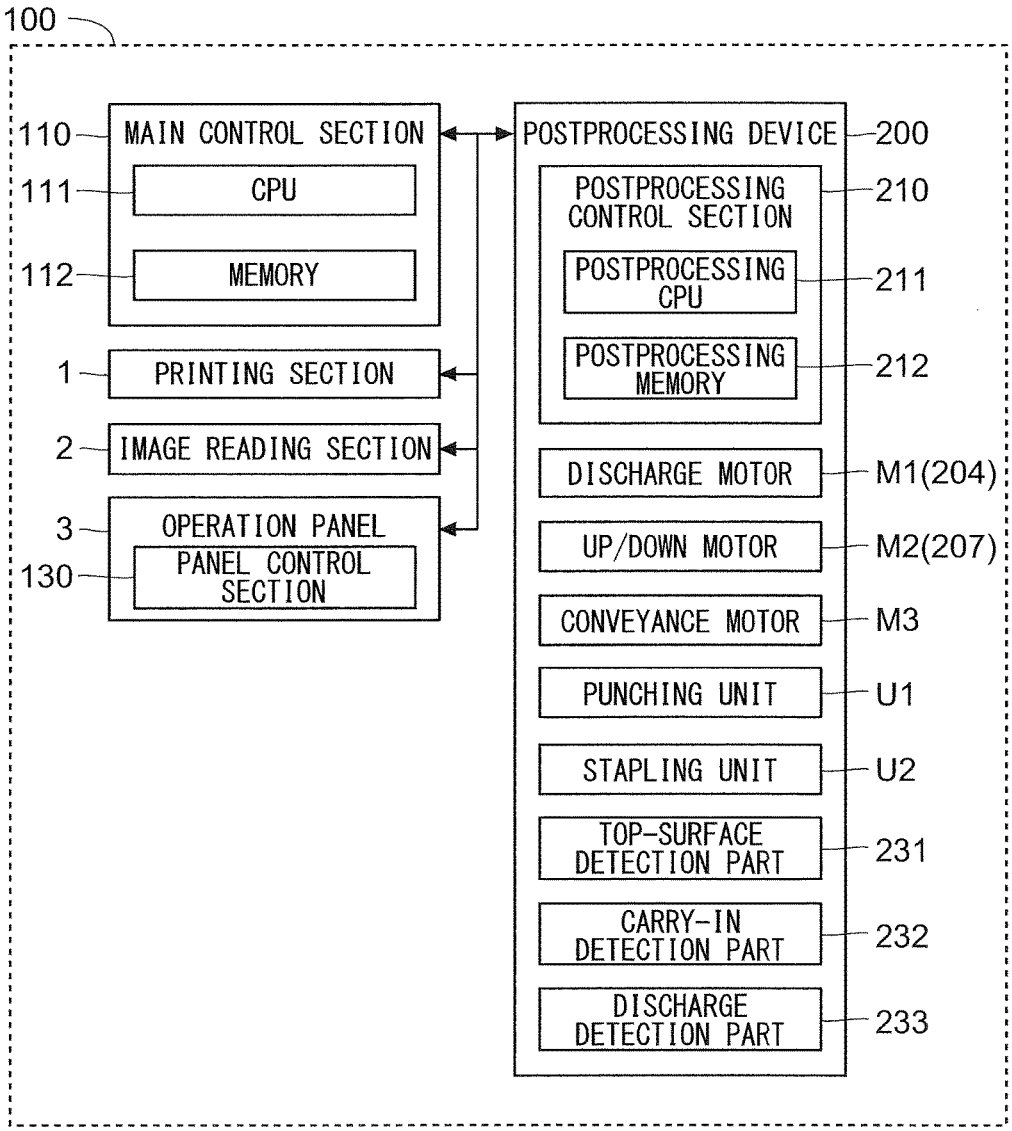
FIG. 3 is a view showing a hardware configuration of the multifunction peripheral according to one embodiment of the disclosure.

As shown in FIG. 3, the multifunction peripheral 100 includes a main control section 110. The main control section 110 includes a CPU 111 and a memory 112 (ROM or RAM). In the memory 112, control-dedicated programs and data for operating the CPU 111 are stored. Then, the main control section 110 (CPU 111) performs overall control of the multifunction peripheral 100. The main control section 110 also performs control for printing operation of the printing section 1 as well as control for reading operation of the image reading section 2.

The multifunction peripheral 100 (operation panel 3) further includes a panel control section 130. The panel control section 130 controls display operation of the operation panel 3 and detects operations effected on the operation panel 3.

The multifunction peripheral 100 (postprocessing device 200) includes a postprocessing control section 210. The postprocessing control section 210 corresponds to 'control section.'

The postprocessing control section 210 includes a postprocessing CPU 211 and a postprocessing memory 212. In the postprocessing memory 212, control-dedicated programs and data for operating the postprocessing CPU 211 are stored. The postprocessing control section 210 (postprocessing CPU 211), upon receiving an instruction from the main control section 110, controls postprocessing operation of the postprocessing device 200.

More specifically, the postprocessing control section 210 controls drive of the discharge motor M1 to rotate the discharge roller pair 241 (controls discharge operation of the sheet P). Also, the postprocessing control section 210 controls drive of the up/down motor M2 to orbitally revolve the up/down belt. That is, the postprocessing control section 210 moves up and down the discharge tray 206 (controls up/down operations of the discharge tray 206). Also, the postprocessing control section 210 controls drive of a conveyance motor M3 for rotating the conveyance roller pairs 203. Further, the postprocessing control section 210 controls individual operations of the punching unit U1 and the stapling unit U2.

The postprocessing control section 210 is connected to a top-surface detection part 231, a carry-in detection part 232, and a discharge detection part 233.

The top-surface detection part 231 is a detection part which has a detection position set at a position under the sheet discharge outlet 202 (discharge roller pair 241), and which serves for detecting whether or not the mounting surface 206*a* of the discharge tray 206 moved up by the up/down moving part 207 or the top surface of a sheet P on the discharge tray 206 (sheet P mounted on the mounting surface 206*a*) has arrived at the detection position. In addition, the detection position of the top-surface detection part 231 (see FIG. 2) is set at such a position that even though the mounting surface 206*a* of the discharge tray 206 (or the top surface of a sheet p on the discharge tray 206) is present at the detection position of the top-surface detection part 231, the sheet P discharged through the sheet discharge outlet 202 does not interfere with the discharge tray 206 (or the sheet P on the discharge tray 206).

For example, the top-surface detection part 231, although not shown, includes an actuator placed at the detection position of the top-surface detection part 231, an optical sensor (sensor having a light-emitting part and a light-receiving part) targeted for the actuator as a detection object, and the like. When the mounting surface 206*a* of the discharge tray 206 moved up by the up/down moving part 207, or the top surface of the sheet P on the discharge tray 206, has arrived at the detection position, the actuator is pressed upward so as to shield (open) an optical path of the optical sensor. In this state, when the discharge tray 206 is moved down, the actuator is released from pressing so as to be moved down (returned to the original position), so that the optical path of the optical sensor is opened (shielded).

As a result of this, an output value of the top-surface detection part 231 (optical sensor) changes depending on whether or not the mounting surface 206*a* of the discharge tray 206 or the top surface of the sheet P on the discharge tray 206 is present at the detection position. In addition, when the mounting surface 206*a* of the discharge tray 206 or the top surface of the sheet P on the discharge tray 206 has arrived at the detection position, the top-surface detection part 231 outputs a top-surface detection signal (the output value of the top-surface detection part 231 changes to a specified level). Then, based on the output value of the top-surface detection part 231, the postprocessing control section 210 detects whether or not the mounting surface 206*a* of the discharge tray 206 moved up by the up/down moving part 207 or the top surface of the sheet P on the discharge tray 206 has arrived at the detection position of the top-surface detection part 231.

The carry-in detection part 232, which is placed at the sheet carry-in inlet 201, changes its output value depending on the presence or absence of a sheet P at the sheet carry-in inlet 201. Based on an output value of the carry-in detection part 232, the postprocessing control section 210 detects a fore-end arrival or rear-end passage of a sheet P at the sheet carry-in inlet 201 (i.e., detects whether or not a sheet P has been carried in). For example, the postprocessing control section 210, based on an output value of the carry-in detection part 232, counts a number of sheets P carried into the postprocessing device 200.

The discharge detection part 233, which is placed at the sheet discharge outlet 202, changes its output value depending on the presence or absence of a sheet P at the sheet discharge outlet 202. Based on an output value of the discharge detection part 233, the postprocessing control section 210 detects a fore-end arrival or rear-end passage of a sheet P at the sheet discharge outlet 202 (i.e., detects whether or not a sheet P has been discharged onto the discharge tray 206). For example, the postprocessing control section 210, upon detecting a rear-end passage of the sheet P based on an output value of the discharge detection part 233, decides that the sheet P (or a bundle of sheets) has been discharged onto the discharge tray 206.

At this point, in order to decide whether or not to execute a later-described state decision process, the postprocessing control section 210 counts a discharge count that is a number of sheets P discharged onto the discharge tray 206. More specifically, the postprocessing control section 210 increments the discharge count when the sheet P is discharged onto the discharge tray 206. It is noted that the count number of the discharge count is reset at the time when the later-described state decision process is executed. Otherwise, the count number of the discharge count may be reset after completion of a job involving the discharge of sheets P.

<Control for Job Execution>

When the operation panel 3 has accepted an execution instruction for a job involving discharge of sheets P (hereinafter, referred to merely as job) from a user, the main control section 110 transmits a job start command to the postprocessing control section 210 and also makes the printing section 1 start the job. That is, the main control section 110 makes the printing section 1 carry out printing and also makes a printed sheet P carried into the postprocessing device 200. In addition, the job start command includes information indicative of postprocessing conditions or the like.

Upon receiving a job start command from the main control section 110, the postprocessing control section 210 recognizes a postprocessing to be executed, based on the information indicative of postprocessing conditions included in the job start command. For example, when stapling process or sorting process is executed, the postprocessing control section 210 recognizes a number of sheets P of a sheet bundle to be processed on the processing tray 205 (i.e., a number of sheets P of a sheet bundle to be discharged onto the discharge tray 206). Then, when the sheets P have been carried into the postprocessing device 200, the postprocessing control section 210 makes the postprocessing device 200 execute necessary postprocessing and discharge processed sheets P (or sheet bundle) onto the discharge tray 206.

Hereinbelow, a control flow for job execution by the postprocessing device 200 will be described with reference to the flowchart shown in FIG. 4. The flowchart shown in FIG. 4 is started when the postprocessing control section 210 has received a job start command from the main control section 110.

Figure 4:
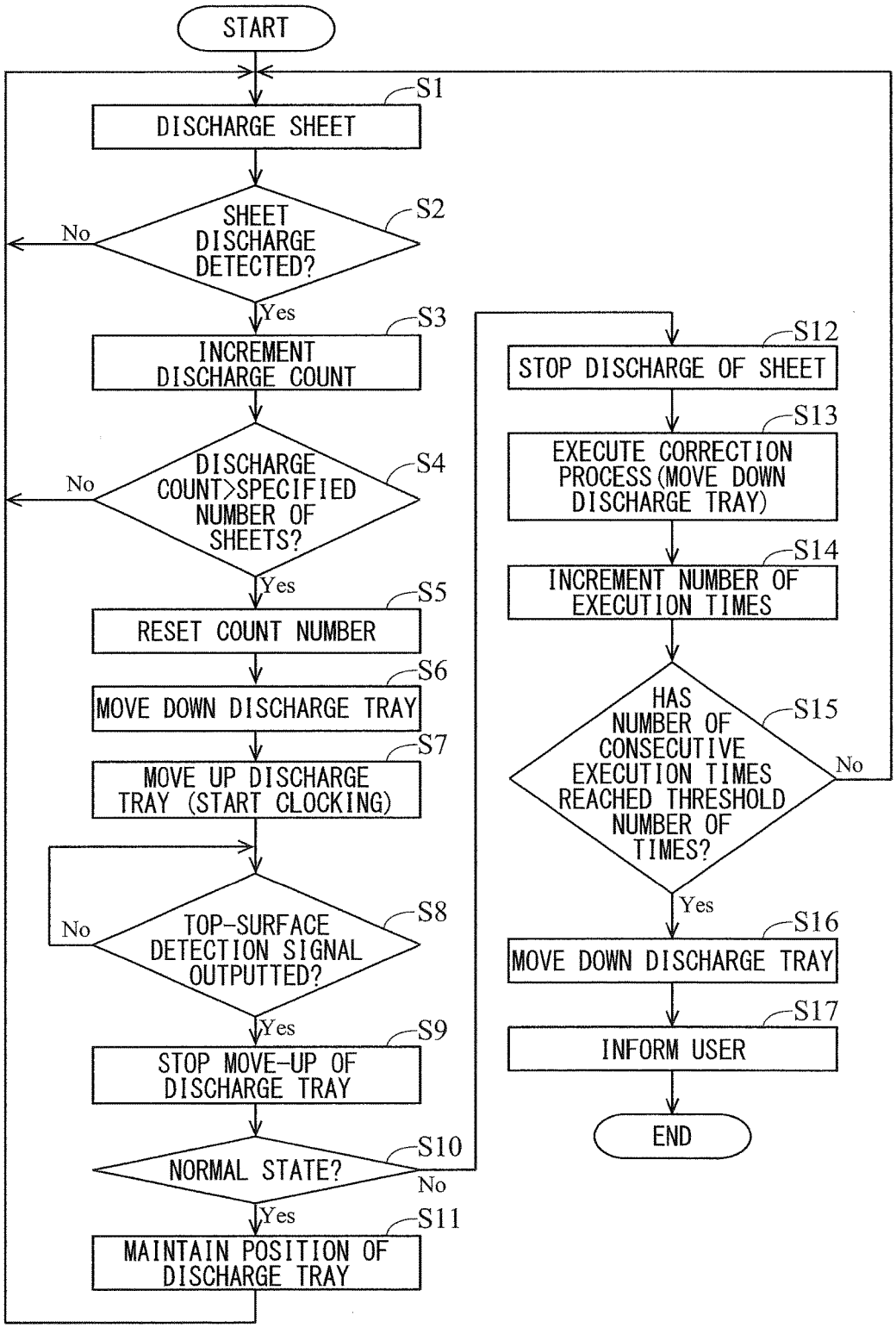
FIG. 4 is a flowchart for explaining a processing flow of job execution carried out by the multifunction peripheral (postprocessing device) according to one embodiment of the disclosure.

At a start point of the flowchart shown in FIG. 4, the mounting surface 206*a* of the discharge tray 206 or the top surface of a sheet P laid at the uppermost layer on the discharge tray 206 is present at the detection position of the top-surface detection part 231. For example, it is allowable to execute a process of, after completion of a last-time executed job, moving up the discharge tray 206 until the mounting surface 206*a* of the discharge tray 206 or the top surface of a sheet P at the uppermost layer on the discharge tray 206 arrives at the detection position of the top-surface detection part 231. Otherwise, it is also allowable to perform the above-described process at the time when a job to be executed this time is started.

At step S1, the postprocessing control section 210 makes the punching unit U1 or the stapling unit U2 perform postprocessing on a sheet P carried into the postprocessing device 200. The postprocessing control section 210 also makes the sheet discharge part 204 discharge the processed sheet P onto the discharge tray 206.

At step S2, the postprocessing control section 210 decides whether or not the discharge detection part 233 has detected discharge of a sheet P onto the discharge tray 206. As a result, when the discharge detection part 233 has detected the discharge of the sheet P, the processing flow moves on to step S3; when the discharge detection part 233 has not detected the discharge of the sheet P, the flow moves on to step S1.

Upon movement to step S3, the postprocessing control section 210 increments a discharge count of sheets P discharged onto the discharge tray 206. In this process, when the sheet discharge part 204 has discharged a sheet bundle, a number of sheets P included in the sheet bundle is counted as a number of the discharge count.

At step S4, the postprocessing control section 210 decides whether or not the discharge count (count number) has exceeded a specified number of sheets. The specified number of sheets is, for example, 30 sheets. When the postprocessing control section 210 decides at step S4 that the discharge count has exceeded the specified number of sheets, the processing flow moves on to step S5; when the postprocessing control section 210 decides that the discharge count has not yet exceeded the specified number of sheets, the flow moves on to step S1.

Upon movement to step S5, the postprocessing control section 210 resets the count number of the discharge count. Then, the postprocessing control section 210 executes a state decision process of deciding a stacking state of sheets P discharged on the discharge tray 206.

Figure 5:
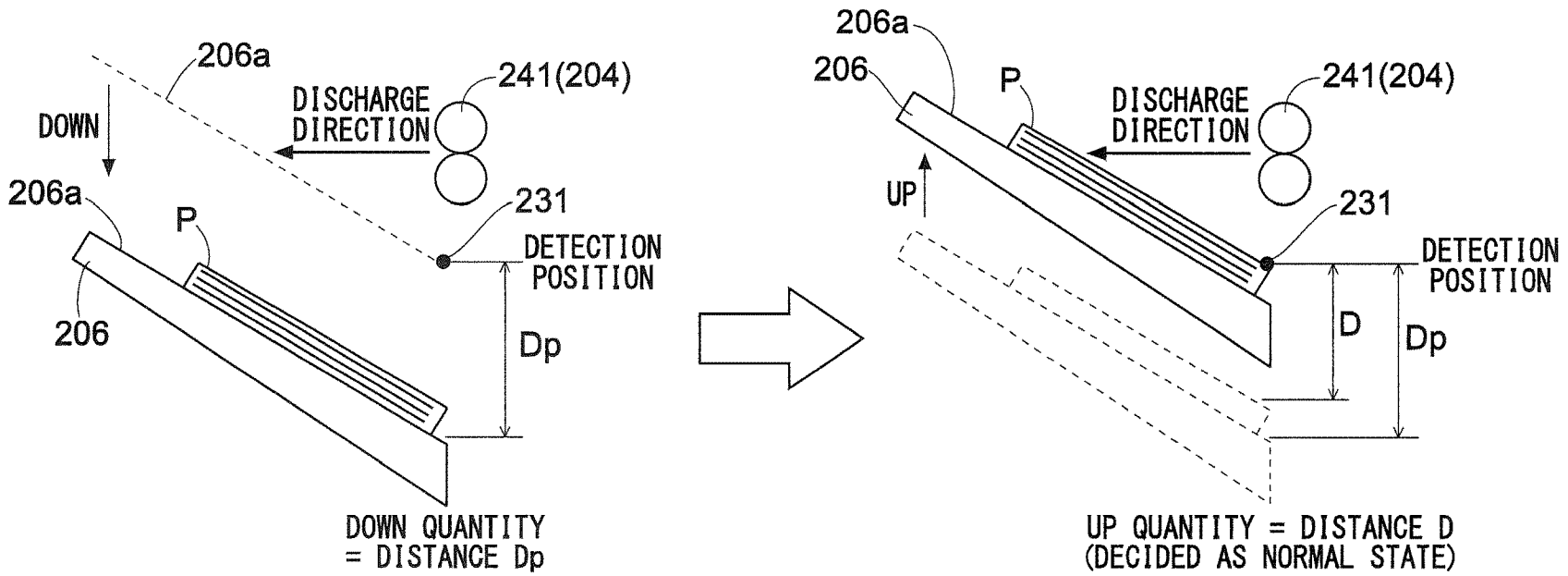
FIG. 5 is a view for explaining a state decision process carried out by the multifunction peripheral (postprocessing device) according to one embodiment of the disclosure (a view in which the sheet stacking state is a normal state)

More specifically, at step S6, the postprocessing control section 210 drives the up/down moving part 207 to move down the discharge tray 206 by a specified quantity (distance) Dp from its current position (see left-hand view of FIG. 5). The specified quantity Dp is set, for example, to 20 mm. Moving down the discharge tray 206 in such a way allows the sheet P to be shifted obliquely downward (toward the upstream side of the sheet discharge direction) on the discharge tray 206 in order that a rear end portion of the sheet P is placed at a position vertically opposed to the top-surface detection part 231 (i.e., a position where the rear end portion of the sheet P is contactable with the top-surface detection part 231). That is, the sheet P is justified in posture on the discharge tray 206. Hereinafter, such a stacking state of the sheet P as shown in FIG. 5 will be referred to as normal state.

Reverting to FIG. 4, at step S7, the postprocessing control section 210 drives the up/down moving part 207 to move up the discharge tray 206. At this time point, the postprocessing control section 210 starts clocking. Next at step S8, the postprocessing control section 210 decides whether or not the top-surface detection part 231 has outputted a top-surface detection signal (i.e., the output value of the top-surface detection part 231 has changed to a specified level). As a result, when the postprocessing control section 210 decides that the top-surface detection signal has been outputted, the processing flow moves on to step S9. When the postprocessing control section 210 decides that the top-surface detection signal has not yet been outputted, the decision of step S8 is repeated.

Upon movement to step S9, the postprocessing control section 210 stops the discharge tray 206 from moving up. Then, at step S10, the postprocessing control section 210 acquires a move-up time that is a time duration lasting from a move-up start of the discharge tray 206 until output of a top-surface detection signal by the top-surface detection part 231; subsequently, based on the acquired move-up time, the postprocessing control section 210 decides a stacking state of the sheet P on the discharge tray 206.

Now it is assumed that, as shown in FIG. 5, the stacking state of sheets P on the discharge tray 206 is a normal state. It is also assumed that a vertical distance D between the top surface of a sheet P laid at the uppermost layer on the discharge tray 206 and the top-surface detection part 231 is 10 mm. Moreover, it is assumed that the move-up speed of the discharge tray 206 is set to 25 mm/s. In this case, when 400 ms has elapsed since a move-up start of the discharge tray 206, the top surface of the sheet P at the uppermost layer on the discharge tray 206 comes into contact with the top-surface detection part 231, where the top-surface detection part 231 outputs a top-surface detection signal. That is, the move-up time is 400 ms (i.e., the discharge tray 206 moves up by the distance D).

Figure 6:
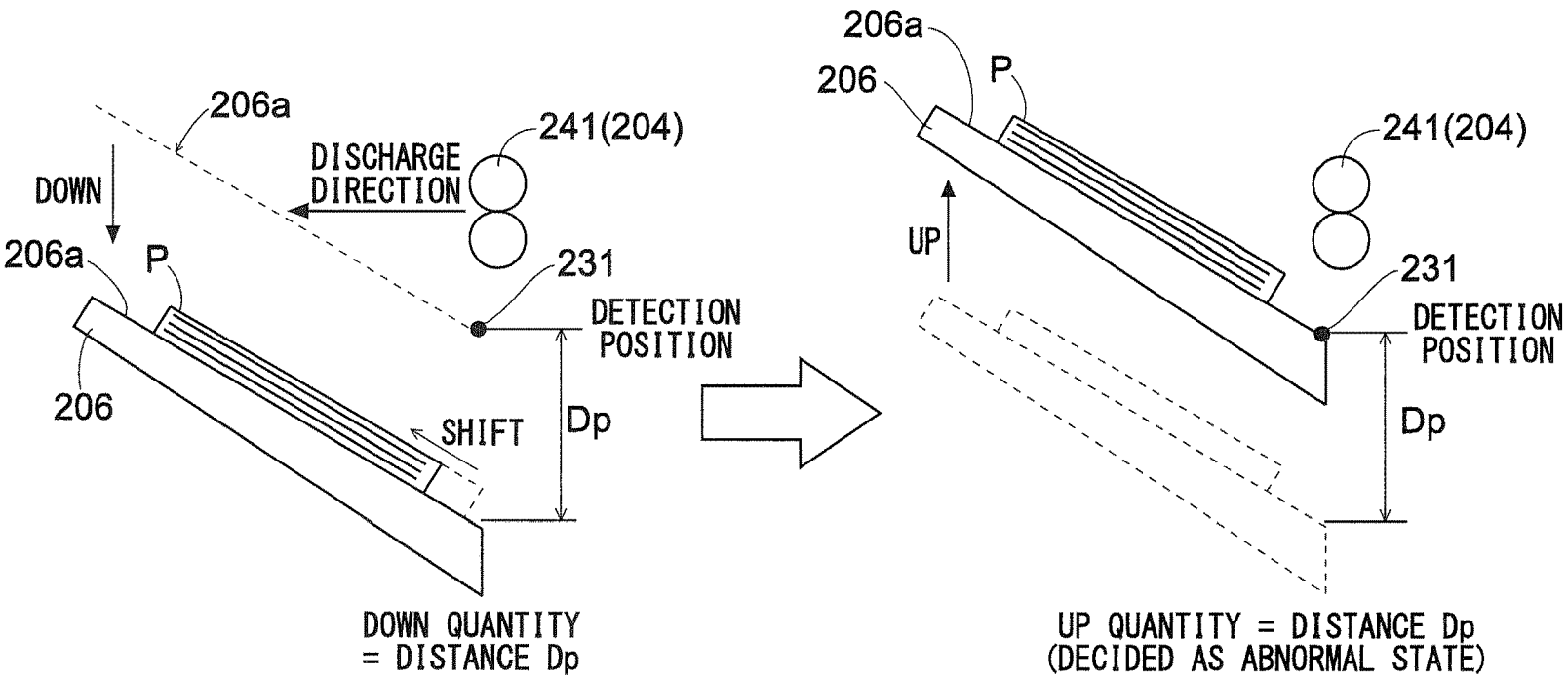
FIG. 6 is a view for explaining a state decision process carried out by the multifunction peripheral (postprocessing device) according to one embodiment of the disclosure (a view in which the sheet stacking state is an abnormal state)

On the other hand, it is assumed, as shown in FIG. 6, that whereas the same number of sheets P as in the case of FIG. 5 have been discharged on the discharge tray 206, the stacking state of the sheets P on the discharge tray 206 is an abnormal state (a state in which the sheets P on the discharge tray 206 are shifted toward the downstream side of the sheet discharge direction). In this case, the top-surface detection part 231 does not output the top-surface detection signal even when 400 ms has elapsed since a move-up start of the discharge tray 206; instead, the top-surface detection part 231 outputs the top-surface detection signal when 800 ms has elapsed since the move-up start of the discharge tray 206. That is, the move-up time is 800 ms (i.e., the discharge tray 206 moves up by the specified quantity Dp).

As described above, the move-up time varies depending on whether the stacking state of the sheets P on the discharge tray 206 is a normal state or an abnormal state; that is, when the stacking state on the discharge tray 206 is an abnormal state, the move-up time becomes longer than when it is a normal state. Accordingly, when the move-up time is equal to or less than a reference time (when the move-up time is shorter), the postprocessing control section 210 decides that the stacking state is a normal state; on the other hand, when the move-up time is more than the reference time (when the move-up time is longer), the postprocessing control section 210 decides that the stacking state is an abnormal state.

The reference time serving as a decision criterion for the stacking state of sheets P is predetermined and set to a time which is shorter than a time (first time) required for the discharge tray 206 to move up by the specified quantity Dp and which is longer than a theoretical value (second time) of the move-up time for the case where a specified number of sheets P have been stacked on the discharge tray 206. The reference time is set, for example, to one half of a sum of the first time and the second time.

Reverting to FIG. 4, when the postprocessing control section 210 decides at step S10 that the stacking state of sheets P on the discharge tray 206 is a normal state, the processing flow moves on to step S11. Upon movement to step S11, the postprocessing control section 210 maintains the vertical position of the discharge tray 206 at its current position. Thereafter, the processing flow moves on to step S1. In this case, while the top surface of the sheet P at the uppermost layer on the discharge tray 206 is present at the detection position of the top-surface detection part 231, the postprocessing control section 210 makes a next sheet P (or sheet bundle) discharged onto the discharge tray 206.

On the other hand, when the postprocessing control section 210 decides at step S10 that the stacking state of the sheets P on the discharge tray 206 is an abnormal state, the postprocessing control section 210 executes a correction process for correcting the vertical position of the discharge tray 206.

More specifically, at step S12, the postprocessing control section 210 stops discharge of a sheet P. Then, at step S13, the postprocessing control section 210 drives the up/down moving part 207 to execute a correction process of moving down the discharge tray 206.

Figure 7:
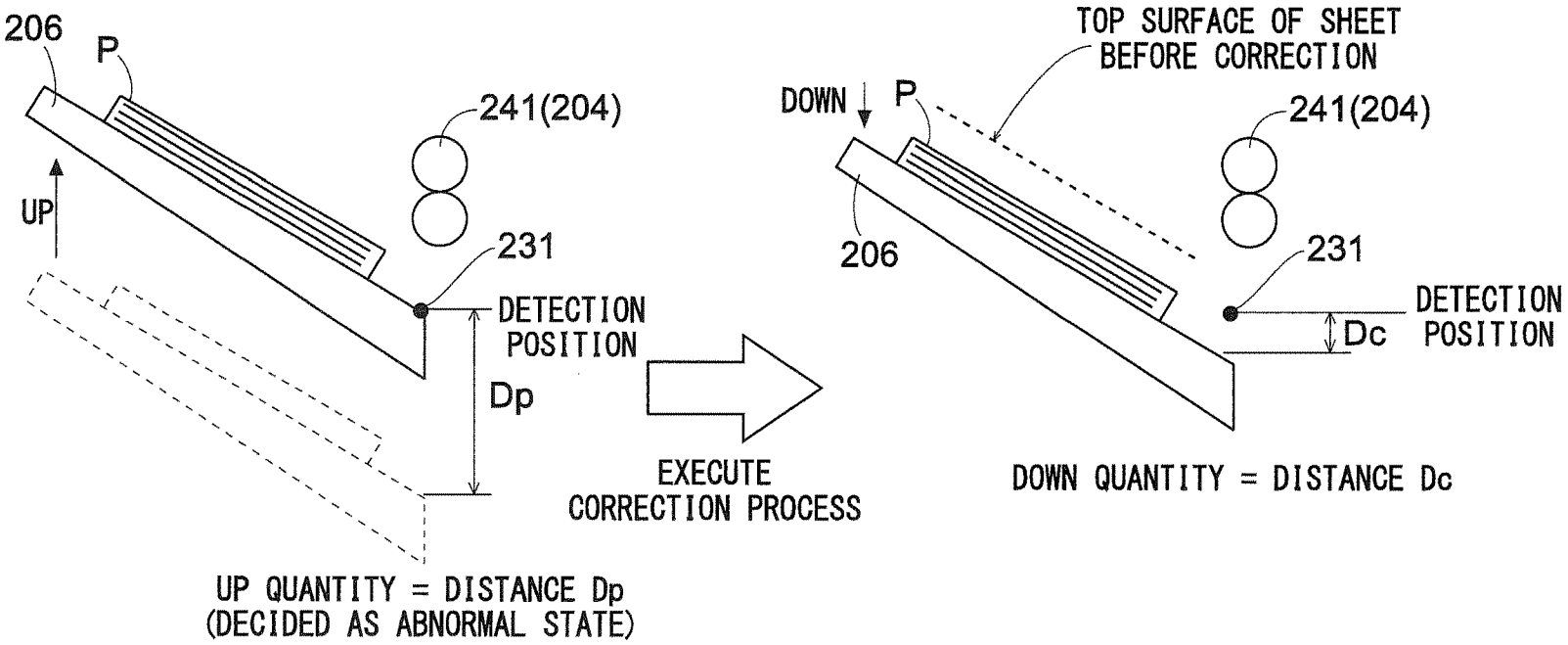
FIG. 7 is a view for explaining a correction process carried out by the multifunction peripheral (postprocessing device) according to one embodiment of the disclosure.

For execution of the correction process, the postprocessing control section 210 determines a correction quantity (distance) Dc resulting from multiplying a time difference, which is obtained by subtracting the reference time from a move-up time (which is longer than the reference time) clocked in the state decision process, by the move-up speed of the discharge tray 206; then, the postprocessing control section 210 drives the up/down moving part 207 so that a move-down quantity of the discharge tray 206 becomes equal to the correction quantity Dc (see FIG. 7). In addition, the correction quantity may be predetermined (the correction quantity may be a constant value).

After execution of the correction process, at step S14, the postprocessing control section 210 increments the number of execution times of the correction process. Then, at step S15, the postprocessing control section 210 decides whether or not the number of execution times of the correction process has reached a predetermined threshold number of times. In addition, when the postprocessing control section 210 decides, as a result of the state decision process, that the stacking state of the sheets P on the discharge tray 206 is a normal state, the count number representing the number of execution times of the correction process is reset. Accordingly, in this case, it is decided whether or not the number of consecutive execution times of the correction process has reached the threshold number of times.

At step S15, when the postprocessing control section 210 decides that the number of consecutive execution times of the correction process has not yet reached the threshold number of times, the processing flow moves on to step S1. In this case, with the discharge tray 206 moved down by a correction quantity, the postprocessing control section 210 makes a next sheet P (or sheet bundle) discharged onto the discharge tray 206. On the other hand, when the postprocessing control section 210 decides that the number of consecutive execution times of the correction process has reached the threshold number of times, the flow moves on to step S16.

Upon movement to step S16, the postprocessing control section 210 drives the up/down moving part 207 to make the discharge tray 206 further moved down by a specified quantity from its current position. Then, at step S17, the postprocessing control section 210 executes processing to prompt the user to check the sheets P on the discharge tray 206. For example, the postprocessing control section 210 transmits an information-request notice to the panel control section 130. The panel control section 130, having received the information-request notice, makes an information message displayed on the operation panel 3 (touch panel display 31). Although not particularly limited, a message indicative that the discharge tray 206 is in a full state is displayed on the operation panel 3. As another example, with a lamp or other lighting unit (corresponding to 'information part') separately provided in the postprocessing device 200, the lamp may be lit or blinked to inform the user that the discharge tray 206 is in a full state.

In addition, the postprocessing control section 210, even after having once executed the state decision process, continues doing the discharge count until the job is completed (the count number of the discharge count is reset when the state decision process is executed). Then, after the execution of the state decision process, each time the discharge count (count number) exceeds the specified number of sheets, the postprocessing control section 210 executes a state decision process similar to the last-time executed state decision process.

Figure 8:
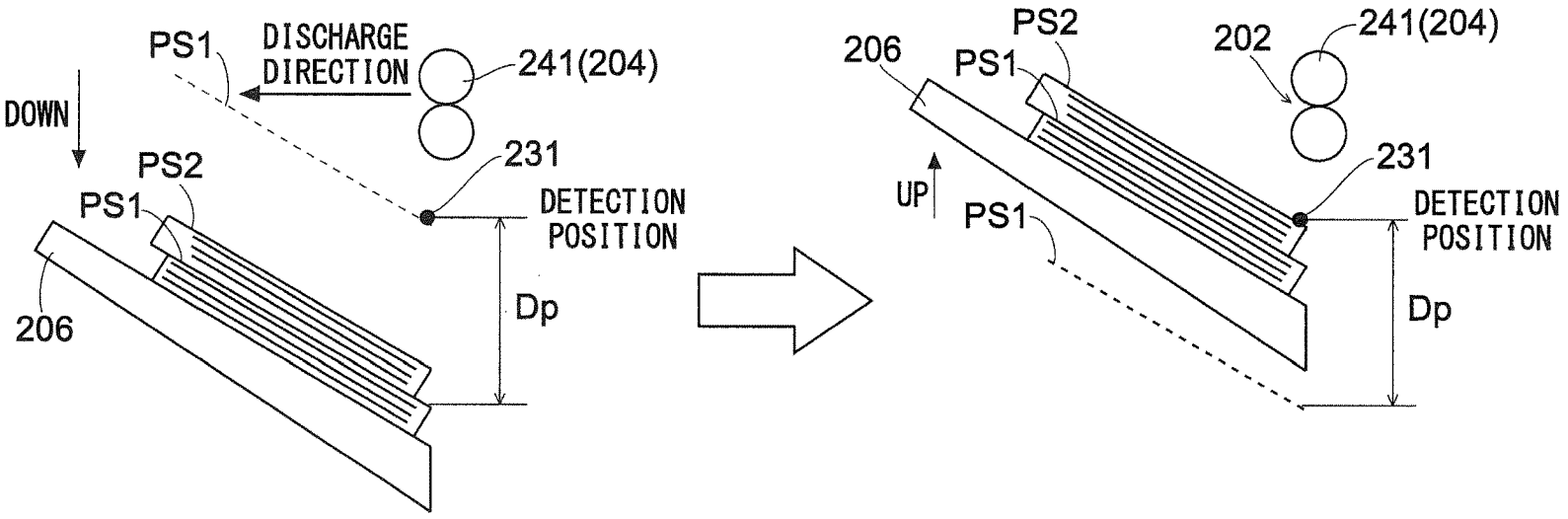
FIG. 8 is a view for explaining a state decision process carried out by the multifunction peripheral (postprocessing device) according to one embodiment of the disclosure.

In more detail, as shown in FIG. 8, after the discharge tray 206 is moved down by the specified quantity Dp, the discharge tray 206 is moved up until the top-surface detection part 231 outputs a top-surface detection signal. Based on a resulting move-up time of the discharge tray 206, it is decided whether or not the stacking state of the sheets P on the discharge tray 206 is a normal state (when the stacking state of the sheets P is an abnormal state, the postprocessing control section 210 executes the correction process). FIG. 8 shows a case in which the stacking state of the sheets P on the discharge tray 206 is a normal state. In FIG. 8, the top surface of a sheet P detected by the top-surface detection part 231 in the last-time state decision process is designated by sign PS1, and the top surface of a sheet P detected by the top-surface detection part 231 in the current-time state decision process is designated by sign PS2.

As described above, the postprocessing device 200 (sheet discharge device) of this embodiment includes: a discharge tray 206 on which a sheet P discharged from a sheet discharge outlet 202 is to be stacked and which is inclined obliquely upward from upstream side toward downstream side of a sheet discharge direction; an up/down moving part 207 for moving up and down the discharge tray 206 in a vertical direction; a sheet discharge part 204 for discharging the sheet P onto the discharge tray 206; a top-surface detection part 231 which has a detection position set at a position under the sheet discharge outlet 202 and which outputs a top-surface detection signal when a top surface of the discharge tray 206 moved up by the up/down moving part 207 or a top surface of the sheet P on the discharge tray 206 has arrived at the detection position; and a postprocessing control section 210 (control section) which, in order to make the sheet discharge part 204 discharge the sheet P onto the discharge tray 206, drives the up/down moving part 207 to move up the discharge tray 206 until the top-surface detection part 231 outputs the top-surface detection signal, by which the top surface of the discharge tray 206 or the top surface of the sheet P on the discharge tray 206 is made to arrive at the detection position of the top-surface detection part 231, the postprocessing control section 210 further executing a state decision process of deciding a stacking state of the sheet P discharged on the discharge tray 206. While counting the discharge count of sheets P discharged on the discharge tray 206, the postprocessing control section 210 keeps the state decision process unexecuted until the discharge count exceeds a specified number of sheets; when the discharge count has exceeded the specified number of sheets, the postprocessing control section 210 executes, as the state decision process, a process of moving down the discharge tray 206 by a specified quantity and thereafter moving up the discharge tray 206 until the top-surface detection part 231 outputs the top-surface detection signal, while the postprocessing control section 210 executes a process of clocking a move-up time lasting from a move-up start of the discharge tray 206 until output of the top-surface detection signal by the top-surface detection part 231. Then, when the move-up time is equal to or less than a predetermined reference time, the postprocessing control section 210 decides that the stacking state is a normal state, where the postprocessing control section 210 makes a next sheet P discharged while the top-surface detection part 231 outputs the top-surface detection signal. On the other hand, when the move-up time is more than the reference time, the postprocessing control section 210 decides that the stacking state is an abnormal state, where the postprocessing control section 210 executes a correction process of moving down the discharge tray 206 before making a next sheet P discharged.

With the constitution of this embodiment, when the move-up time is equal to or less than the reference time (when the move-up time is short), it is decided that the stacking state of the sheet P is a normal state; on the other hand, when the move-up time is more than the reference time (when the move-up time is long), it is decided that the stacking state of the sheet P is an abnormal state. In this case, when the stacking position of the sheet P on the discharge tray 206 is shifted toward the downstream side of the sheet discharge direction, the move-up time becomes longer than when it is not shifted. Therefore, executing the state decision process on a basis of the move-up time makes it possible to decide whether or not the stacking position of the sheet P on the discharge tray 206 is shifted toward the downstream side of the sheet discharge direction (in an abnormal state).

Then, when the stacking position of the sheet P on the discharge tray 206 is shifted toward the downstream side of the sheet discharge direction (in an abnormal state), the correction process of moving down the discharge tray 206 is executed and then the next sheet P is discharged. Accordingly, discharging of this sheet P can be prevented from blockage by an already discharged sheet P (a sheet P whose stacking position on the discharge tray 206 is shifted toward the downstream side of the sheet discharge direction). As a result, occurrence of discharge failures (e.g., paper jam) of sheets P can be suppressed.

In this connection, the time difference between a move-up time in a case where the stacking position of the sheet P on the discharge tray 206 is shifted toward the downstream side of the sheet discharge direction and another move-up time in a case where it is not shifted becomes smaller and smaller with lessening number of sheets P that are targeted for the state decision process. Therefore, under the condition that the state decision process is executed even with a small number of sheets P targeted for the state decision process (e.g., under the condition that the state decision process is executed each time a sheet P is discharged onto the discharge tray 206), it is more likely that mis-decisions occur.

For this reason, under the conditions of this embodiment, the state decision process is not executed until the discharge count exceeds a specified number of sheets, and the state decision process is executed when the discharge count has exceeded the specified number of sheets. That is, the state decision process is executed under the condition that the number of sheets P targeted for the state decision process has exceeded a specified number of sheets (the state decision process is not executed under the condition that the number of sheets P targeted for the state decision process is small). As a result of this, occurrence of mis-decisions can be suppressed.

Also in this embodiment, as described above, the postprocessing control section 210 resets the count number of the discharge count upon execution of the state decision process, and after the execution of the state decision process, the postprocessing control section 210 executes the state decision process each time the discharge count (count number) exceeds the specified number of sheets. As a result of this, even when the stacking state of the sheets P discharged on the discharge tray 206 has come to an abnormal state after the last-time execution of the state decision process, the state decision process (correction process) is executed once again at a time point when the discharge count counted since the last-time state decision process has exceeded the specified number of sheets. Thus, occurrence of discharge failures with sheets P can be suppressed.

Also in this embodiment, as described above, when a number of consecutive execution times of the correction process has reached a predetermined threshold number of times, the postprocessing control section 210 makes the operation panel 3 (information part) give information for prompting the user to check the sheets P on the discharge tray 206. As a result of this, it can be suppressed that a high likelihood of discharge failures with sheets P may be left as it is.

Also in this embodiment, the postprocessing control section 210 executes, as the correction process, a process of moving down the discharge tray 206 by a quantity corresponding to a time period resulting from subtracting the reference time from the move-up time. As a result of this, it can be suppressed that the discharge tray 206 may be moved down to more than a necessary extent.

The embodiment disclosed herein should be construed as not being limitative but being an exemplification at all points. The scope of the disclosure is defined not by the above description of the embodiment but by the appended claims, including all changes and modifications equivalent in sense and range to the claims.

What is claimed is:

1. A sheet discharge device comprising:

a sheet carry-in inlet for carrying in a sheet;

a carry-in detection part which is placed at the sheet carry-in inlet and which changes an output value thereof depending on a presence or absence of a sheet at the sheet carry-in inlet;

a sheet discharge outlet for discharging a sheet;

a discharge tray on which a sheet discharged from the sheet discharge outlet is to be stacked and which is inclined obliquely upward from an upstream side toward downstream side of a sheet discharge direction;

an up/down moving part for moving up and down the discharge tray in a vertical direction;

a sheet discharge part for discharging a sheet onto the discharge tray;

a top-surface detection part which has a detection position set at a position under the sheet discharge outlet and which outputs a top-surface detection signal when a top surface of the discharge tray moved up by the up/down moving part or a top surface of a sheet on the discharge tray has arrived at the detection position; and a control section which, in order to make the sheet discharge part discharge a sheet onto the discharge tray, drives the up/down moving part to move up the discharge tray until the top-surface detection part outputs the top-surface detection signal, by which the top surface of the discharge tray or the top surface of the sheet on the discharge tray is made to arrive at the detection position, the control section further executing a state decision process of deciding a stacking state of sheets discharged on the discharge tray, wherein while counting a discharge count of sheets discharged on the discharge tray based on the output of the carry-in detection part, the control section keeps the state decision process unexecuted until the discharge count exceeds a specified number of sheets; when the discharge count has exceeded the specified number of sheets, the control section executes, as the state decision process, a process of moving down the discharge tray by a specified quantity and thereafter moving up the discharge tray until the top-surface detection part outputs the top-surface detection signal, the control section further executing a process of clocking a move-up time lasting from a move-up start of the discharge tray until output of the top-surface detection signal by the top-surface detection part, when the move-up time is equal to or less than a predetermined reference time, the control section decides that the stacking state is a normal state, where the control section makes a next sheet discharged while the top-surface detection part outputs the top-surface detection signal; on the other hand, when the move-up time is more than the reference time, the control section decides that the stacking state is an abnormal state, where the control section executes a correction process of moving down the discharge tray before making the next sheet discharged, and the control section resets a count number of the discharge count upon execution of the state decision process, and after the execution of the state decision process, the control section executes the state decision process each time the discharge count exceeds the specified number of sheets.

2. The sheet discharge device according to claim 1, further comprising an information part for giving information to a user, wherein when a number of consecutive execution times of the correction process has reached a predetermined threshold number of times, the control section makes the information part give information for prompting the user to check a sheet on the discharge tray.

3. The sheet discharge device according to claim 1, wherein the control section executes, as the correction process, a process of moving down the discharge tray by a quantity corresponding to a time period resulting from subtracting the reference time from the move-up time.

4. An image forming apparatus including the sheet discharge device according to claim 1.

5. A sheet discharge device comprising:

a sheet carry-in inlet for carrying in a sheet;

a carry-in detection part which is placed at the sheet carry-in inlet and which changes an output value thereof depending on a presence or absence of a sheet at the sheet carry-in inlet;

a sheet discharge outlet for discharging the sheet;

a discharge tray on which a sheet discharged from the sheet discharge outlet is to be stacked and which is inclined obliquely upward from an upstream side toward downstream side of a sheet discharge direction;

an up/down moving part for moving up and down the discharge tray in a vertical direction;

a sheet discharge part for discharging a sheet onto the discharge tray;

a top-surface detection part which has a detection position set at a position under the sheet discharge outlet and which outputs a top-surface detection signal when a top surface of the discharge tray moved up by the up/down moving part or a top surface of a sheet on the discharge tray has arrived at the detection position; and a control section which, in order to make the sheet discharge part discharge a sheet onto the discharge tray, drives the up/down moving part to move up the discharge tray until the top-surface detection part outputs the top-surface detection signal, by which the top surface of the discharge tray or the top surface of the sheet on the discharge tray is made to arrive at the detection position, the control section further executing a state decision process of deciding a stacking state of sheets discharged on the discharge tray, wherein while counting a discharge count of sheets discharged on the discharge tray based on the output of the carry-in detection part, the control section keeps the state decision process unexecuted until the discharge count exceeds a specified number of sheets; when the discharge count has exceeded the specified number of sheets, the control section executes, as the state decision process, a process of moving down the discharge tray by a specified quantity and thereafter moving up the discharge tray until the top-surface detection part outputs the top-surface detection signal, the control section further executing a process of clocking a move-up time lasting from a move-up start of the discharge tray until output of the top-surface detection signal by the top-surface detection part, when the move-up time is equal to or less than a predetermined reference time, the control section decides that the stacking state is a normal state, where the control section makes a next sheet discharged while the top-surface detection part outputs the top-surface detection signal; on the other hand, when the move-up time is more than the reference time, the control section decides that the stacking state is an abnormal state, where the control section executes a correction process of moving down the discharge tray before making the next sheet discharged, the reference time is one half of a sum of a first time and a second time, the first time is a time required for the discharge tray to move up by the specified quantity; and the second time is a theoretical value of the move-up time for a case where a specified number of sheets have been stacked on the discharge tray.

6. A sheet discharge device comprising:

a sheet carry-in inlet for carrying in a sheet;

a carry-in detection part which is placed at the sheet carry-in inlet and which changes an output value thereof depending on a presence or absence of a sheet at the sheet carry-in inlet;

a sheet discharge outlet for discharging the sheet;

a discharge detection part which is placed at the sheet discharge outlet and which changes an output value thereof depending on presence or absence of a sheet at the sheet discharge outlet;

a discharge tray on which a sheet discharged from the sheet discharge outlet is to be stacked and which is inclined obliquely upward from an upstream side toward downstream side of a sheet discharge direction;

an up/down moving part for moving up and down the discharge tray in a vertical direction;

a sheet discharge part for discharging a sheet onto the discharge tray;

a top-surface detection part which has a detection position set at a position under the sheet discharge outlet and which outputs a top-surface detection signal when a top surface of the discharge tray moved up by the up/down moving part or a top surface of a sheet on the discharge tray has arrived at the detection position; and a control section which, in order to make the sheet discharge part discharge a sheet onto the discharge tray, drives the up/down moving part to move up the discharge tray until the top-surface detection part outputs the top-surface detection signal, by which the top surface of the discharge tray or the top surface of the sheet on the discharge tray is made to arrive at the detection position, the control section further executing a state decision process of deciding a stacking state of sheets discharged on the discharge tray, wherein while counting a discharge count of sheets discharged on the discharge tray based on the output of the carry-in detection part, the control section keeps the state decision process unexecuted until the discharge count exceeds a specified number of sheets; when the discharge count has exceeded the specified number of sheets, the control section executes, as the state decision process, a process of moving down the discharge tray by a specified quantity and thereafter moving up the discharge tray until the top-surface detection part outputs the top-surface detection signal, the control section further executing a process of clocking a move-up time lasting from a move-up start of the discharge tray until output of the top-surface detection signal by the top-surface detection part, when the move-up time is equal to or less than a predetermined reference time, the control section decides that the stacking state is a normal state, where the control section makes a next sheet discharged while the top-surface detection part outputs the top-surface detection signal; on the other hand, when the move-up time is more than the reference time, the control section decides that the stacking state is an abnormal state, where the control section executes a correction process of moving down the discharge tray before making the next sheet discharged, and the control section detects whether or not a sheet has been discharged onto the discharge tray based on the output value of the discharge detection part.

* * * * *